US007011165B2

(12) United States Patent
Kristen et al.

(10) Patent No.: US 7,011,165 B2
(45) Date of Patent: Mar. 14, 2006

(54) ROTATING ELECTRIC HAND TOOL IMPLEMENT WITH SAFETY ROUTINE

(75) Inventors: Ferdinand Kristen, Gilching (DE); Hans-Werner Bongers-Ambrosius, Munich (DE)

(73) Assignee: Hilti Aktiengesellschaft, Furstentum (LI)

( * ) Notice: Subject to any disclaimer, the term of this patent is extended or adjusted under 35 U.S.C. 154(b) by 155 days.

(21) Appl. No.: 09/847,806

(22) Filed: May 2, 2001

(65) Prior Publication Data

US 2001/0042630 A1 Nov. 22, 2001

(30) Foreign Application Priority Data

May 2, 2000 (DE) ..... 100 21 356

(51) Int. Cl.
*B25D 13/00* (2006.01)

(52) U.S. Cl. ..... 173/1; 173/2; 173/176; 173/178

(58) Field of Classification Search ..... 173/217, 173/176, 2, 1, 4, 6, 20, 170, 178; 408/9; 192/144, 147, 150
See application file for complete search history.

(56) References Cited

U.S. PATENT DOCUMENTS 4,165,789 A * 8/1979 Rogers ..... 175/27
4,384,493 A * 5/1983 Grunbaum ..... 73/862.29
4,426,588 A * 1/1984 Weilenmann ..... 307/124
4,487,270 A * 12/1984 Huber ..... 173/176
5,170,358 A * 12/1992 Delio ..... 700/177
5,385,512 A * 1/1995 Moolenaar et al. ..... 475/153
5,584,619 A * 12/1996 Guzzella ..... 408/9
5,879,111 A * 3/1999 Stock et al. ..... 408/6
5,914,882 A * 6/1999 Yeghiazarians ..... 700/177
5,954,457 A * 9/1999 Stock et al. ..... 408/6
6,044,918 A * 4/2000 Noser et al. ..... 173/176
6,123,158 A * 9/2000 Steffen ..... 173/217

* cited by examiner

*Primary Examiner*—Scott A. Smith
(74) *Attorney, Agent, or Firm*—Abelman, Frayne & Schwab

(57) ABSTRACT

An electric hand tool apparatus (1) for driving a drill-like tool, which carries out an at least partial rotational movement, has within a housing (2), an electric motor (4) without or free of collector and slip ring, the rpm of which can be controlled by motor control electronics (3), wherein an rpm-dependent clutch (5) for transferring the torque is disposed in a force transfer path from the electric motor (4) to a transmission (6). Optionally, to prevent an excessively high twisting of the housing (2), a sensor (7) is evaluated and the rpm of the electric motor (4) is reduced in order to sever the transfer of force by the rpm-dependent clutch (5).

4 Claims, 1 Drawing Sheet

ROTATING ELECTRIC HAND TOOL IMPLEMENT WITH SAFETY ROUTINE

BACKGROUND OF THE INVENTION

The invention relates to a coordinated, rotating, electric hand tool apparatus, particularly a drill, a hammerdrill or a combination hammer, and to a method of safe operation thereof.

In the case of large, high-powered, rotating, electric hand tool apparatus, the danger exists of injuring the operator by means of excessive rotation of the housing as the latter is carried along due to the sudden obstruction of the tool as a consequence of the kinetic energy stored in the electric hand tool apparatus. The danger of injury is particularly high if the apparatus is obstructed as it is started, that is, if the tool is obstructed when it is initially switched on.

Usually, the sudden high angular momentum, producing this rotation due to the obstruction, is separated from the blocked tool by slip clutches or safety clutches or is limited with respect to the torque. Frequently, however, the separation is delayed so that, due to the rotational energy already transferred to the housing of the electric hand tool apparatus, an excessively high rotation of the housing can no longer be prevented.

In DE 3128410 A1, the measurement of the torque, acting on the housing over the handle guiding the electric hand tool implement, is known. A safety device, for avoiding the obstruction, jamming and blocking of a tool, is activated when a limiting value is exceeded by the analogous integration of a signal proportional to the torque. The guidance of the electric hand tool apparatus by the operator, necessary to build up the counter-force at the handle, is a disadvantage.

The EP 666148 B 1 discloses a method of and an apparatus for avoiding excessively high torsion angles of electric hand tool apparatus which, using a microcontroller, calculates in advance, from the actual angular acceleration of the housing, the torsional angle of the housing, which is to be expected at a future time and, when a limiting value is exceeded, activates a safety device to prevent this value from being exceeded. When the start of the apparatus is obstructed, it may nevertheless happen in isolated cases, especially when weak power supply systems with a high internal resistance are used, that the acceleration of the rotor of the electric motor, which builds up only slowly in such a case, results in such a slight angular acceleration of the housing, that the torsional angle of the housing, calculated in advance, does not exceed the limiting value and consequently the safety device is not activated.

From DE 19631517 A1, the use of electric motors without collectors and slip rings, the rpm of which can be controlled over motor control electronics, especially the use of switched magnetic reluctance motors in electric hand tool apparatus, as well as the air cooling of the control electronics in the housing, is known.

SUMMARY OF THE INVENTION

It is primary object of the invention to provide a simple separation of the transmission of power in the case of electric hand tool apparatus. A further object is a solution for reliably preventing an excessively high twisting of the housing of the electric hand tool apparatus.

Essentially, an electric motor, without collector and slip ring, is provided and its rpm which can be controlled by motor control electronics, or a switched magnetic reluctance motor, especially in the case of an excessively high twisting, which is to be expected in the future and is recorded by a sensor and a microcontroller connected to the housing, and the motor is decelerated with respect to the rpm over the motor control electronics, as a result of which, when the rpm of the clutch is not attained, a strictly mechanical, centrifugal force-controlled clutch for transferring the torque, disposed in the force transfer path between the electric motor and a transmission, severs the transmission of forces.

The rpm-controllable electric motors without collectors and slip rings can rapidly be braked actively over motor control electronics, as a result of which an excessively long afterrunning can be reliably prevented.

A further advantage of this solution involves the omission of the electromechanical clutch, otherwise used for the safety routines required, as a result of which the weight of the apparatus can be reduced and the manufacturing costs lowered.

The invention is described in greater detail with respect to an advantageous embodiment and by means of a drawing.

DETAILED DESCRIPTION OF THE INVENTION

Figure 1:
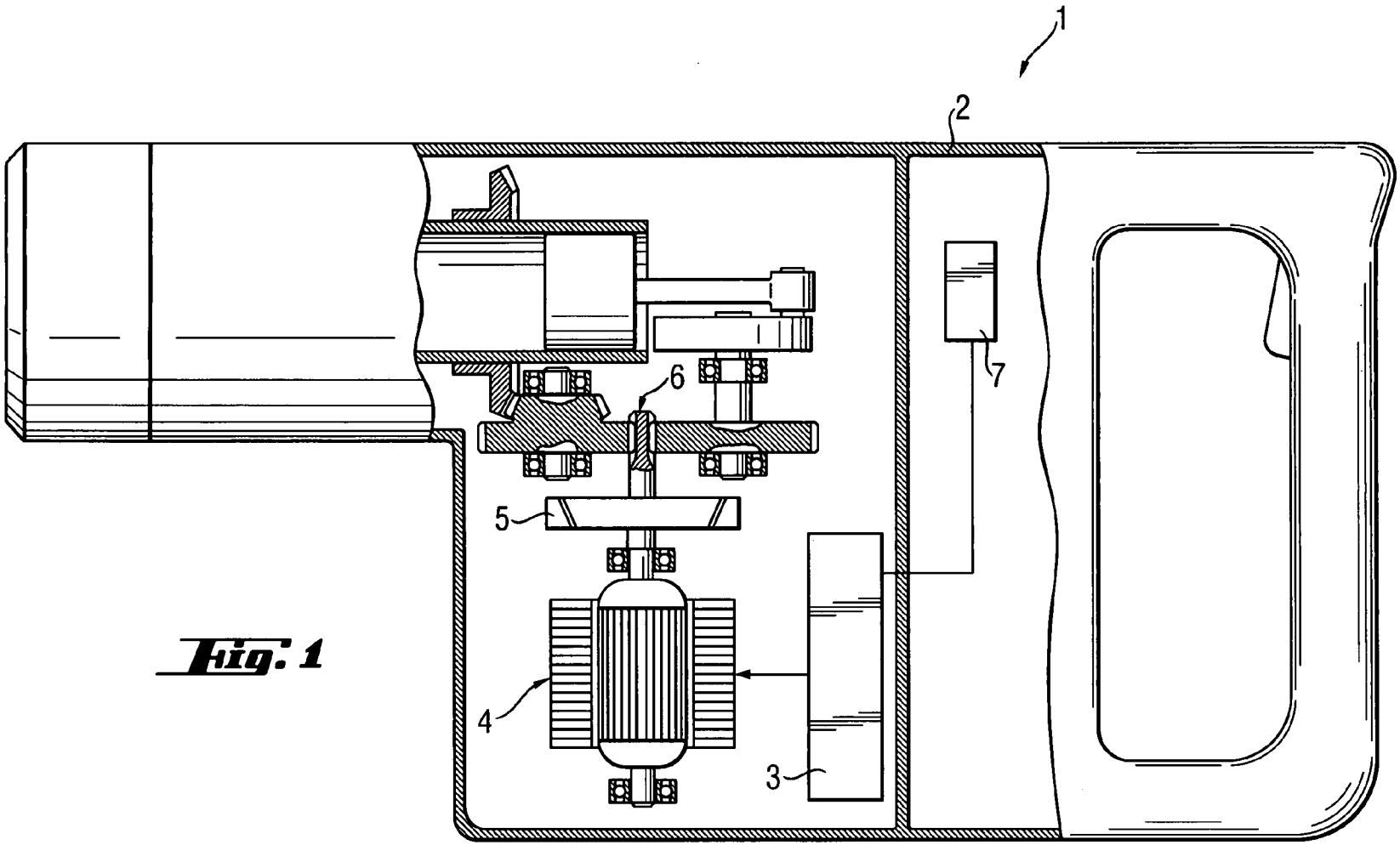
FIG. 1 is a side elevational view, partly in section, of an electric hand tool apparatus embodying the invention.

According to FIG. 1, a hammerdrill electric hand tool apparatus 1 has within a housing 2, an electric motor 4 without or free of a collector and slip ring, and the rpm of which can be controlled by motor control electronics 3, especially a switched magnetic reluctance motor, which is connected, for transfer driving power over a force transfer path containing a strictly mechanical, rpm-dependent clutch 5 to a transmission 6. Moreover, the housing 2 is connected with a sensor 7, which is evaluated by a microcontroller, for determining a future, excessively high twisting of the housing 2.

The method for limiting an excessively high twisting of the housing in the event of an obstruction of the apparatus comprises

- in a first step, in the event of an excessively high twisting, recorded by the microcontroller with sensor and to be expected in the future, the triggering of a safety signal by the microcontroller,
- in a second step, the slowing down of the rpm of the rpm-controllable electric motor without collector and slip ring, over the motor control electronics,
- in a further step, when the clutch rpm is not attained, the interruption of the force transfer path with respect to the transfer of the torque by the rpm-dependent clutch,
- as well as, in an optional last step, the polling and evaluation of the continued existence of the safety signal before the electric motor is accelerated by the motor control electronics, by means of which, in the event of an obstruction at the start, the starting up of the electric motor and, with that, an excessively high twisting of the housing are reliably prevented.

What is claimed is:

1. An electric hand tool apparatus for driving a drilling tool effecting at least partially a rotational movement and comprising a housing (2), an electric motor (4) within said housing, free of a collector and slip ring for producing a torque, motor control electronics (3) including a microcontroller within said housing (2) in operational engagement with said electric motor (4) and arranged to control the rpm of said electric motor and to actively rapidly brake said electric motor, a force transfer path from said motor (4) to a transmission (6), and a strictly mechanical rpm-dependent clutch (5) in the force transfer path between said electric motor (4) and said transmission (6) for transmitting torque from said electric motor (4) to said transmission (6), and a sensor (7) evaluated by said microcontroller is connected within and to said housing (2) for determining a future excessively high twisting of said housing for actively braking said electric motor, whereby a torque transfer from said electric motor to said transmission is interrupted when rpm of said electric motor, which is being braked, is less than rpm of said clutch.

2. An electric hand tool apparatus, as set forth in claim 1, wherein said electric motor (4) is a magnetic reluctance motor.

3. A method of operating an electric hand tool apparatus for limiting an excessively high twisting of a housing of the electric hand tool apparatus in the event of an obstruction of the apparatus during operation, the electric hand tool apparatus comprising a housing (2), an electric motor (4) for producing a torque and being free of a collector and slip ring, motor control electronics (3) including a microcontroller within the housing (2) in operational engagement with the electric motor for controlling rpm of the torque thereof, a transmission (6) within the housing (2) for transmitting rotational movement along a force transfer path from the motor (4) to the transmission (6), and a strictly mechanical rpm-dependent clutch (5) in the force transfer path for transmitting torque from the electric motor (4) to the transmission (6), a sensor (7) connected with the housing for detecting a future excessively high twisting of the housing (2), comprising the steps of triggering a safety signal when an excessively high twisting of the housing is recorded by the sensor (7) and evaluated by said microcontroller, actively rapidly braking the rpm of the electric motor (4) via the microcontroller of the motor control electronics (3), and with the reduction of the rpm of the electric motor, interrupting the transfer of torque over the force transfer path when the rpm of the electric motor is less than the rpm of the clutch.

4. A method, as set forth in claim 3, comprising the steps of polling and evaluating the safety signal before accelerating the electric motor via the motor control electronics (3).

* * * * *